US011685477B2

(12) United States Patent
Campisi

(10) Patent No.: US 11,685,477 B2
(45) Date of Patent: Jun. 27, 2023

(54) ANCHORING DEVICE

(71) Applicant: Michael L. Campisi, St Louis, MO (US)

(72) Inventor: Michael L. Campisi, St Louis, MO (US)

( * ) Notice: Subject to any disclaimer, the term of this patent is extended or adjusted under 35 U.S.C. 154(b) by 232 days.

(21) Appl. No.: 17/242,892

(22) Filed: Apr. 28, 2021

(65) Prior Publication Data

US 2022/0081071 A1 Mar. 17, 2022

Related U.S. Application Data

(60) Provisional application No. 63/016,409, filed on Apr. 28, 2020.

(51) Int. Cl.
*B63B 21/04* (2006.01)

(52) U.S. Cl.
CPC ..... *B63B 21/04* (2013.01)

(58) Field of Classification Search
CPC ..... B63B 21/04
See application file for complete search history.

(56) References Cited

FOREIGN PATENT DOCUMENTS

GB 2463912 A * 3/2010 ..... B63B 21/34

* cited by examiner

*Primary Examiner* — S. Joseph Morano
*Assistant Examiner* — Jovon E Hayes

(57) ABSTRACT

A collapsible anchoring device is disclosed. The device includes a generally shaped frame made of metal and having a front and rear section. The frame includes two to four spades welded/formed to the front and rear sections ranging from 35 to 55-degree angles. Two or four spades are welded/formed on top of the frame and two or four spaded are welded/formed on the bottom side of the frame. Four butt hinges are welded to each end of the frame with stainless steel, galvanized, and or powder coated hardware in order allow the anchor to fold and lay flat. A handle bar attached to said frame and adapted for attachment to a boat anchor line.

1 Claim, 12 Drawing Sheets

ANCHORING DEVICE

CROSS-REFERENCE TO RELATED APPLICATION

This application claims priority to provisional application Ser. No. 63/016,409 filed Apr. 28, 2020 entitled "Anchoring Device" and which is herein incorporated by reference.

TECHNICAL FIELD

The present invention generally relates to the field of anchoring devices and methods and more particularly, is directed to a multi-use anchoring device that can be used in a wide variety of applications.

BACKGROUND OF THE INVENTION

Anchoring devices, such as stakes, spikes and watercraft anchors are well known in the art. Stakes and spikes are often used to secure land-based structures such as tents and the like to a fixed location. Watercraft anchors provide a similar function in water by mooring a boat or ship to the water's bottom.

While most anchoring devices are relatively simple in construction, their complexity can greatly increase due to the size of the object to be secured or the surrounding conditions. Even then, prior art anchors can still pose problems.

For example, there are several issues with watercraft anchors that pose numerous problems for today's boaters. Depending on how busy the lake, river, and/or inner-ocean areas are the anchor most likely does not hold properly.

Weather also has an effect; once an anchor is dropped into the water, the wind pushes the boat causing it to circle around the intended anchor point. This in turn causes a pull on the anchor in another direction, dislodging the anchor from holding the watercraft properly.

Most anchors are designed to just sit on the bottom of a lake, river, or ocean floor, with the hopes that it will catch on something to hold the boat in place. If the area has a lot of watercraft traffic, that area will end up with a lot of wakes. The wake effect can cause a watercraft to bounce or ride the wake up and down. This will cause a sudden shock to the anchor rope, which in turn causes the anchor to become dislodged from the bottom of the lake, river, or ocean bottom.

Another issue with prior art anchors is that they are big and bulky and not quite the easiest to store away for safe travel. Depending on the weight of the anchor, they can cause damage to the inside of the storage area from bouncing around, or accidently being dropped while being handled.

On land, anchors such as stakes and spikes are subject to being pulled out of the ground as they have limited catch points in the ground.

While traditional anchoring devices serve many useful purposes, they remain deficient in a number of ways. The present invention addresses these deficiencies.

SUMMARY OF THE INVENTION

The present invention is a state-of-the art anchoring device that brings anchoring to a new level of sophistication, allowing a user to have more control over the placement of, for example, a boat in any situation, regardless of the current and bottom condition.

Making the anchoring device of the invention easier to handle than prior anchors, the present invention requires no chain and only a 2 to 1 scope; that's twice the depth of the water and half the amount of line required for a traditional anchor.

Scope is often defined as the ratio of the line connecting a boat to an anchor with respect to the depth of the water. Thus, for a 10 foot line and 10 feet of water, the scope is 10:10 or 1:1. Accordingly, for a 20 foot line and 10 feet of water, the scope is 20:10 or 2:1.

The anchoring device of the invention is designed to do all the work for the user. In a watercraft, it requires only tossing the anchor overboard. The anchoring device will hit the bottom, roll to its side, and set within one foot with no need to power down. The device's unique design allows it to hold a boat at a 45-degree angle from the bottom, digging its downward facing spades firmly into the bottom without snagging them permanently on debris. When it comes to retrieval, the user need only pull the line to bring the watercraft over the top of the device and the lack of upward facing surface area will allow the device to pop right off the bottom.

The anchoring device of the invention also has applications on land. It can be used to replace traditional stakes and spikes in many situations. The device has also proved effective as an anchoring point for a winch.

When winches are used it is customary that the winch be fixed in position by attaching it to a vehicle, another heavy object or to even a large tree. The end of the cable or chain from the winch is attached to the object to be moved.

There are many occasions where an attachment point to secure the position of a winch is not available. For example, in many self-recovery situations for off road vehicles that are stuck in mud or sand, a suitable anchor for the winch may not be available. The anchoring device of the present invention solves this problem by serving as a secure attachment point for the winch.

BRIEF DESCRIPTION OF THE DRAWINGS

The novel features of the present invention are set out with particularity in the appended claims, but the invention will be understood more fully and clearly from the following detailed description of the invention as set forth in the accompanying drawings in which:

DESCRIPTION OF A PREFERRED EMBODIMENT

An example embodiment of the present invention will now be described with reference to the accompanying drawings.

Figure 1:
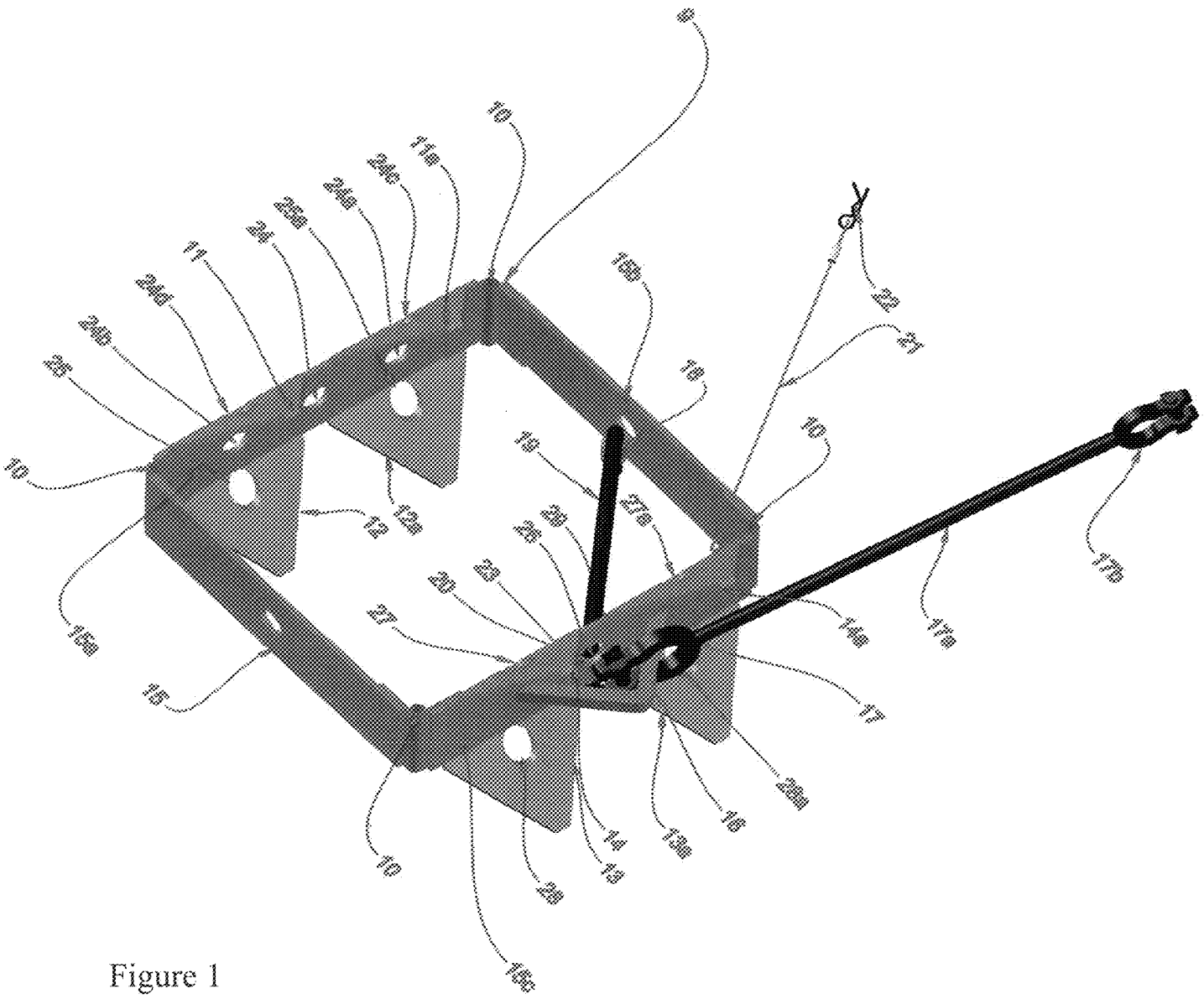
FIGS. 1-8 depict the construction of an anchor device in accordance with one embodiment of the present invention.
Figure 2:
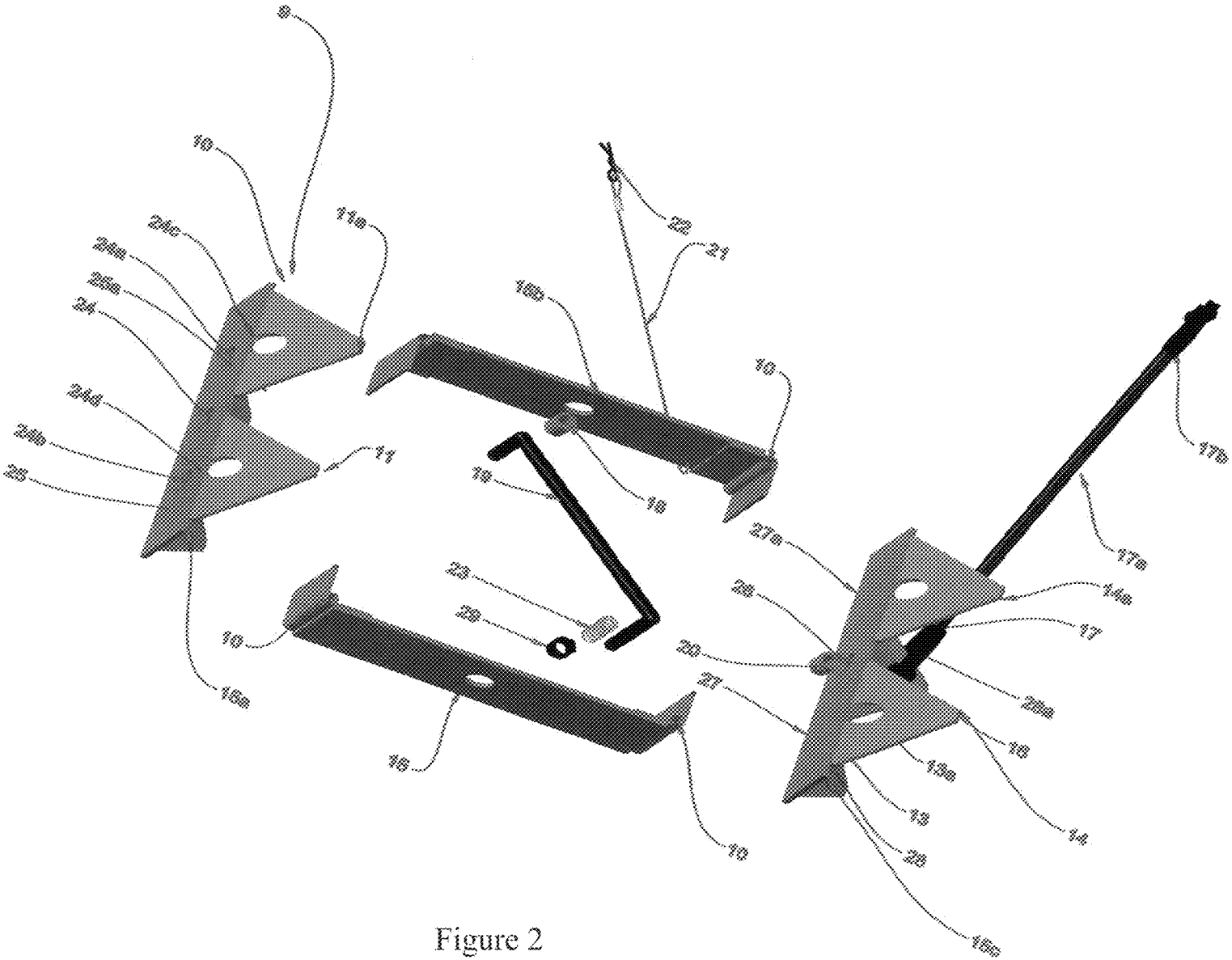
Figure 3:
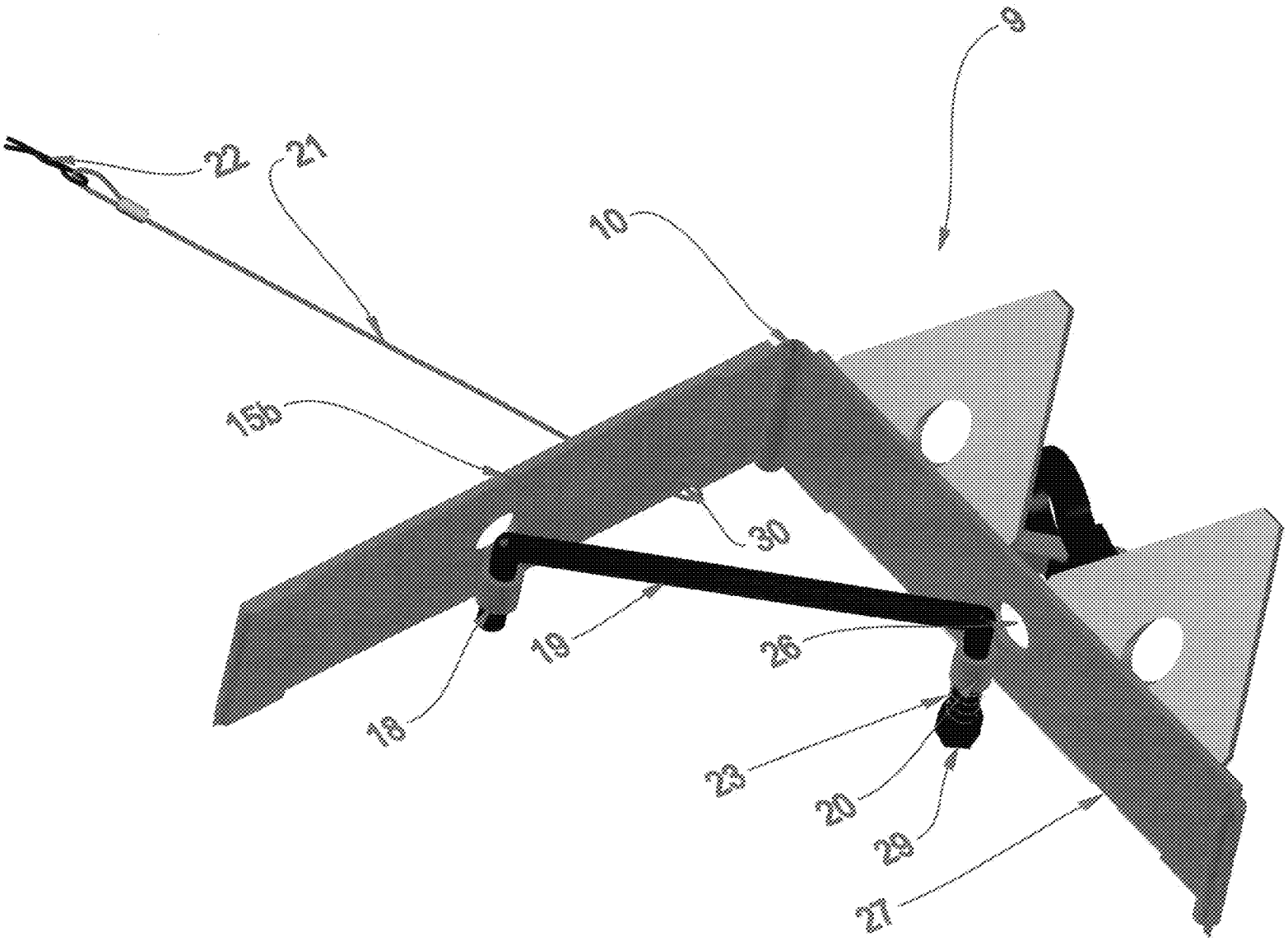
Figure 4:
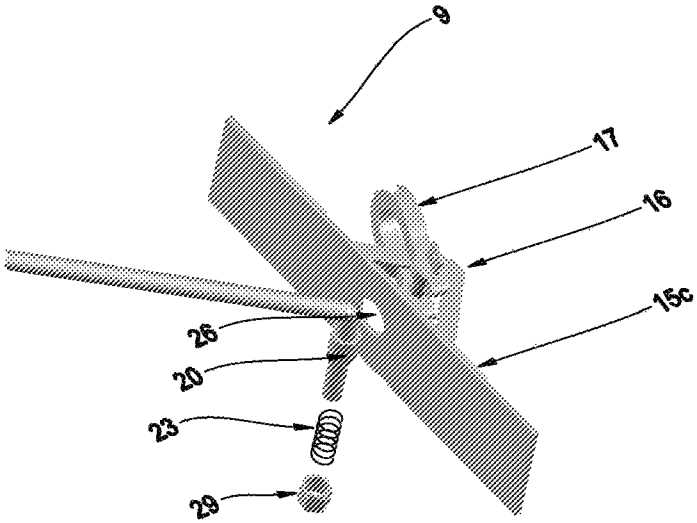
Figure 5:
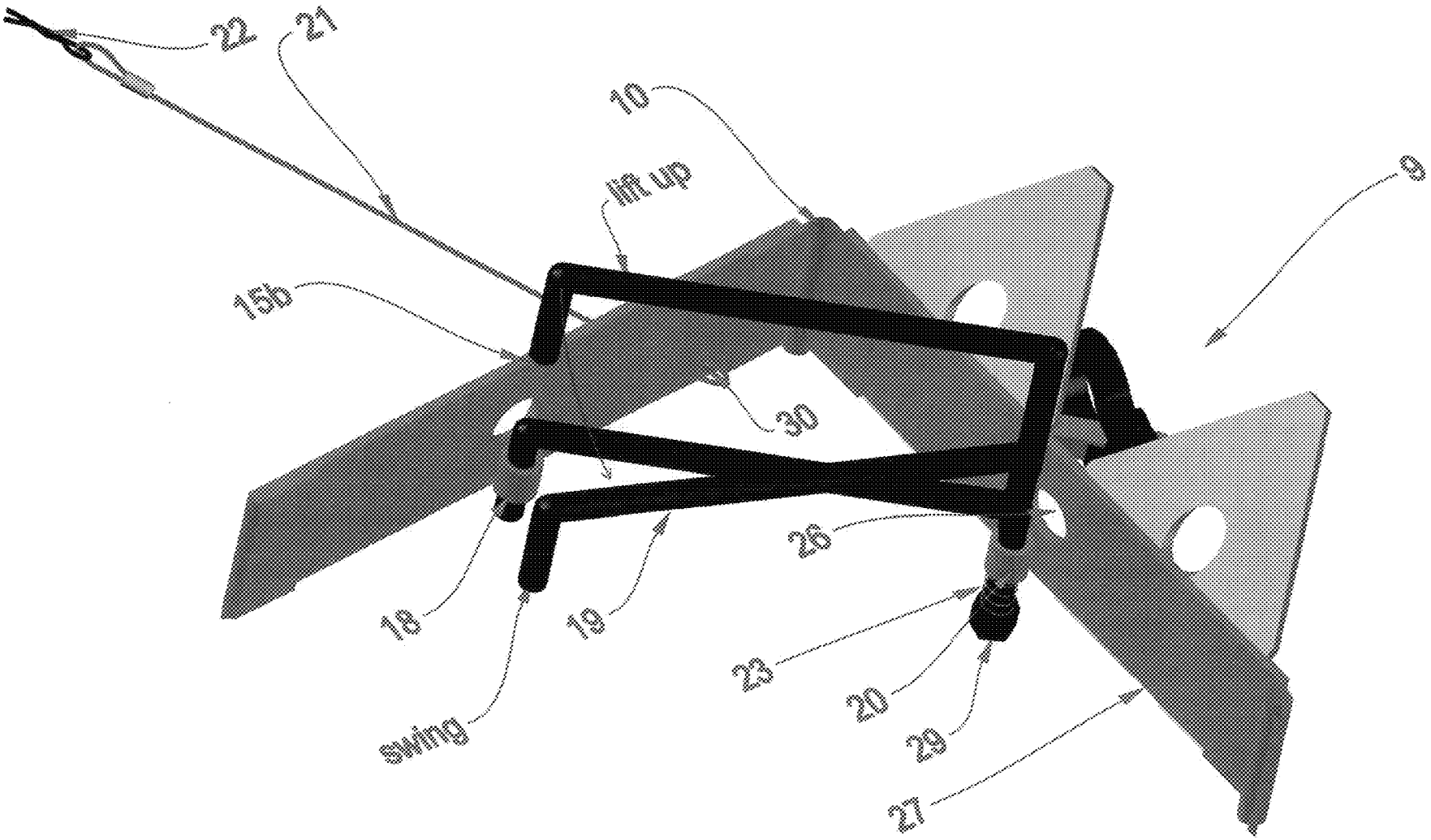
Figure 6:
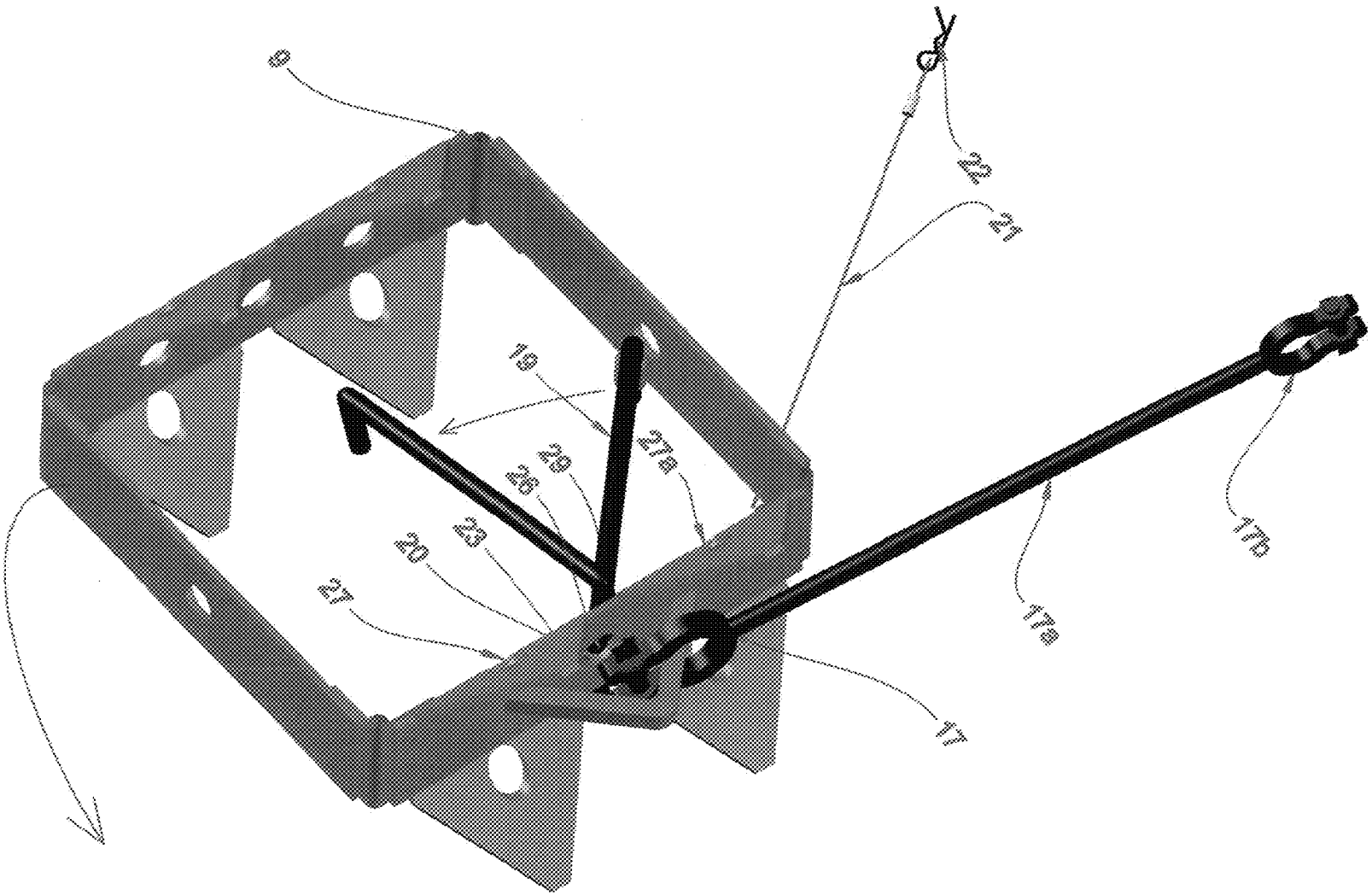
Figure 7:
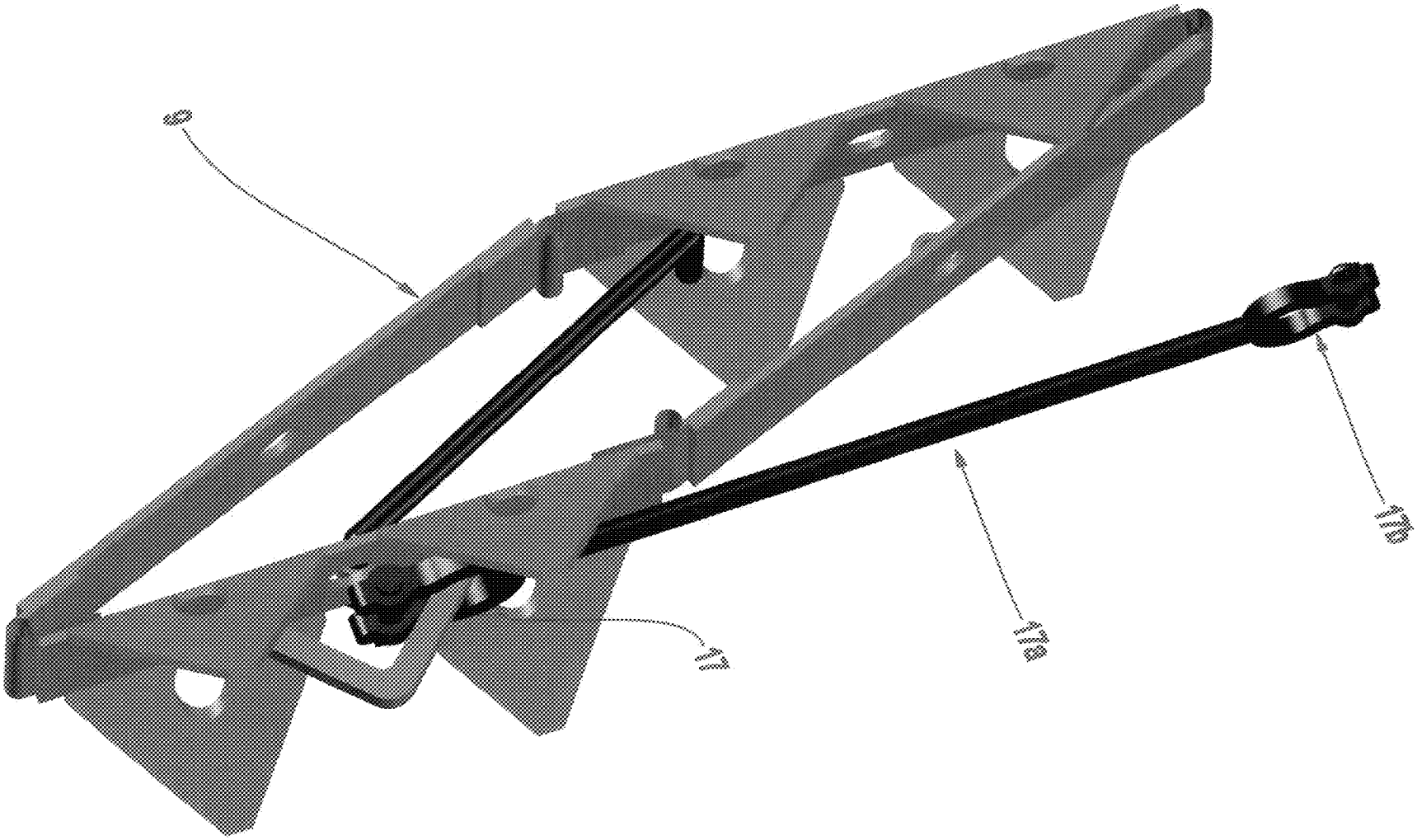
Figure 8:
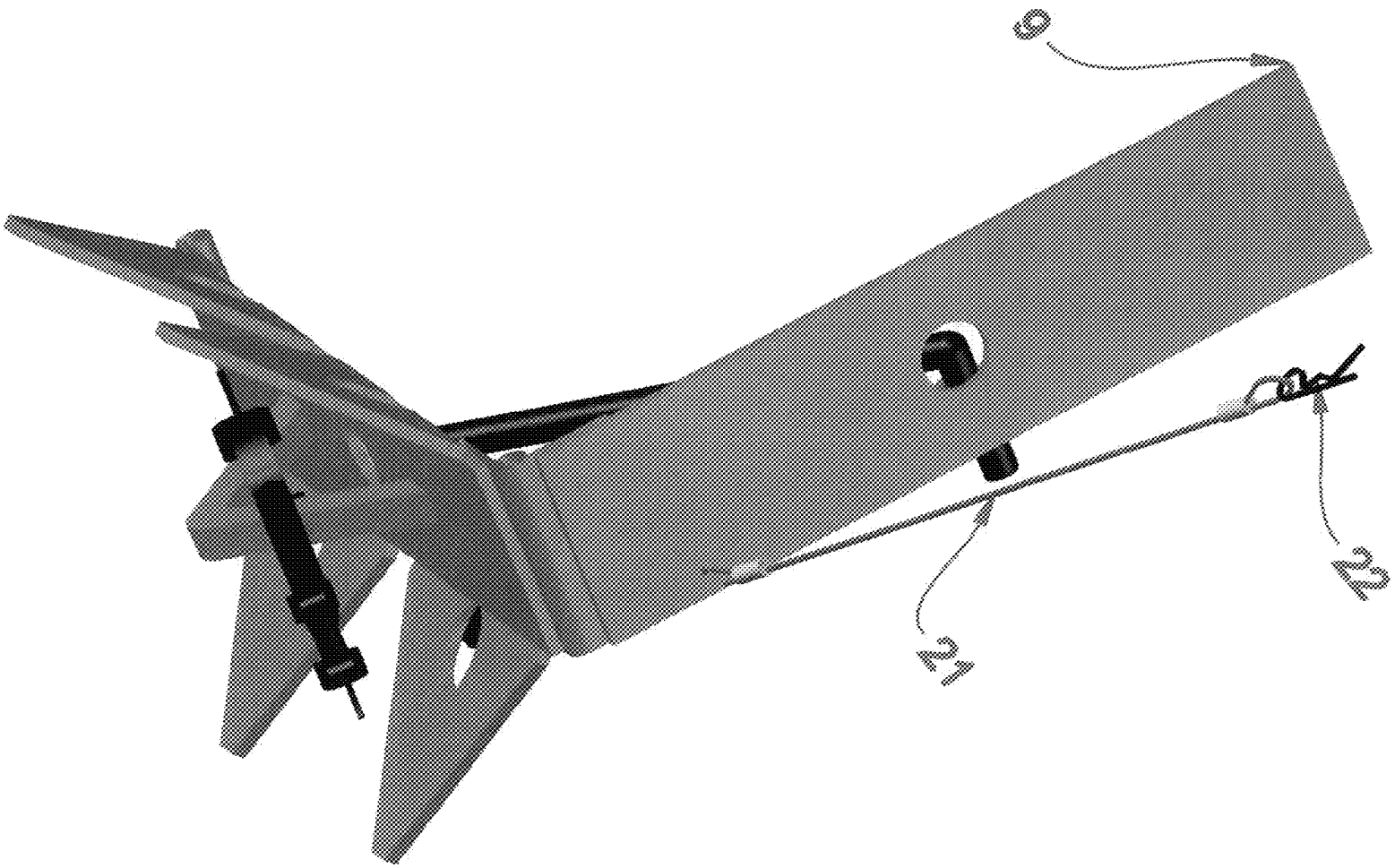

The present invention provides a collapsible anchoring device 9 as shown in FIG. 1 that lays flat for storage for storage and in its square form can flip to the opposite side to anchor, for example, a watercraft, in place.

Device 9 has a frame 10 which can be constructed of hot or cold rolled flat stock steel, stainless steel, aluminum or any high impact material of significant strength. Frame 10 may also be a polished stainless steel, galvanized, and or coated with a high strength powder coating for protection.

Frame 10 includes two to four anchor teeth 12, 12*a*, 13 and 13*a* downwardly attached to Frame 10 as shown in FIG. 1 at an angle ranging from 35 to 55-degrees. Frame 10 also includes drain holes 24, 24*a*, 24*b*, 24*c*, 24*d*, 25 and 25*a* as also shown in FIG. 1.

Frame 10 also includes a plurality of butt hinges, such as 10, that are welded to each end with stainless steel, galvanized, and or powder coated hardware. The hinges will allow the anchor to fold and lay flat.

As further shown in FIG. 1, a lock bar 19 is attached to the Frame 10 with a ⅜ inch or ½-inch solid steel or stainless-steel bar 17 that is threaded at one end, and consist of one ⅜ inch or ½-inch stainless steel nylon lock nut 29 and tension spring 23, along with a hitch pin 22 to secure it into place.

Handle/drag bar 16 consist of a ½-inch solid steel or stainless-steel bar with one or two ⅜ inch galvanized/stainless steel clevis rings welded to each end (depending on the size of the anchor) and or ⅜ inch galvanized/stainless steel clevis ring at one end along with a ½ inch galvanized/stainless steel clevis ring welded at the opposite end. The clevis ring is also used to attach the anchor rope to.

The front mount is attached to a ½-inch solid steel or stainless-steel bar that has a 90-degree bend in the center and is welded to the center of the top frame section.

FIGS. 2-8 illustrate the present invention in greater detail.

Figure 12:
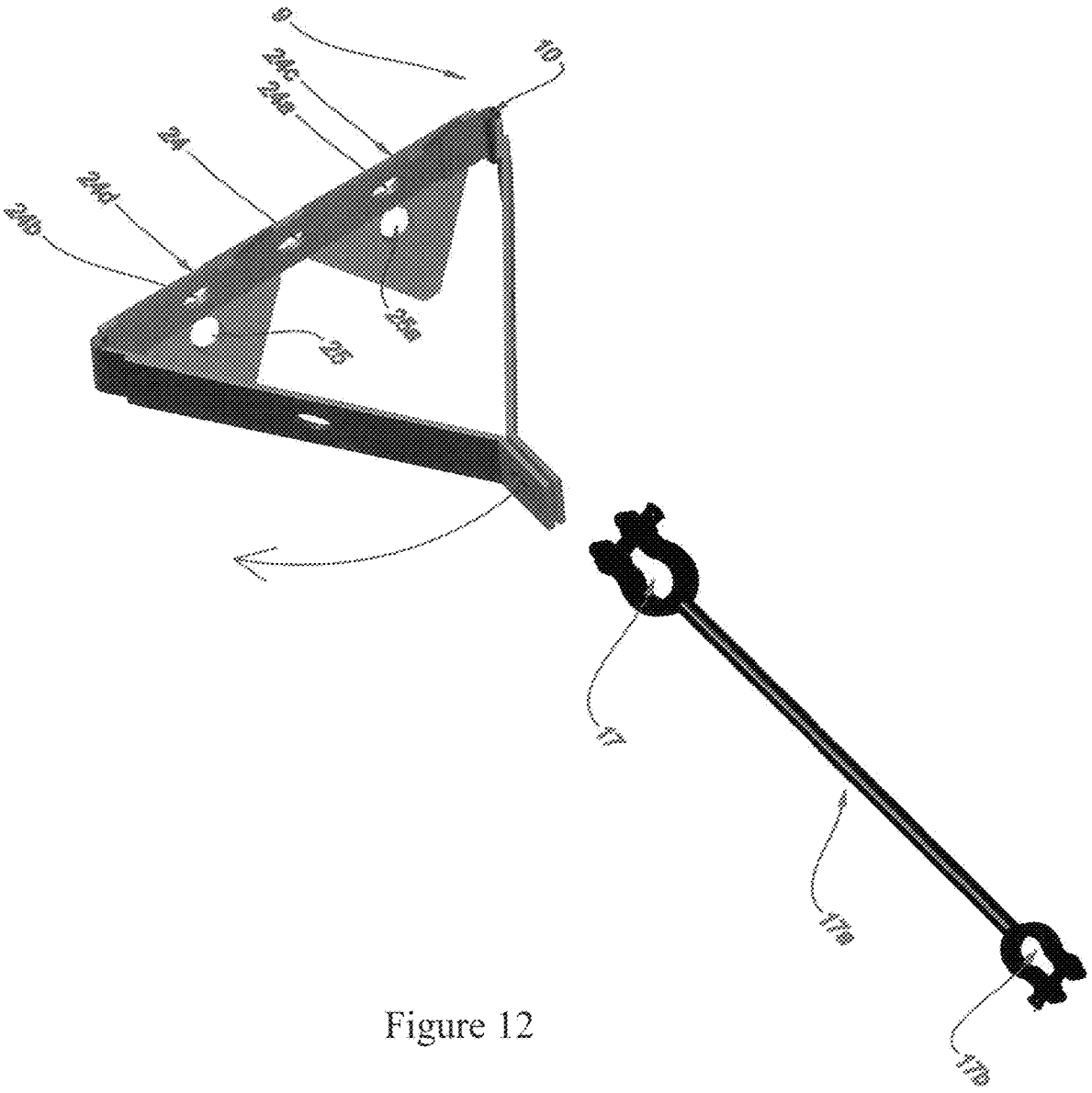
FIG. 12 depict the construction of an anchor device in accordance with a further embodiment of the present invention.

FIG. 12 illustrated another embodiment of the present invention using a smaller number of anchor teeth.

The anchoring device of the present invention is designed to keep the watercraft at mooring for both short and/or long periods of time and for similar use on land with land-based objects.

Figure 9:
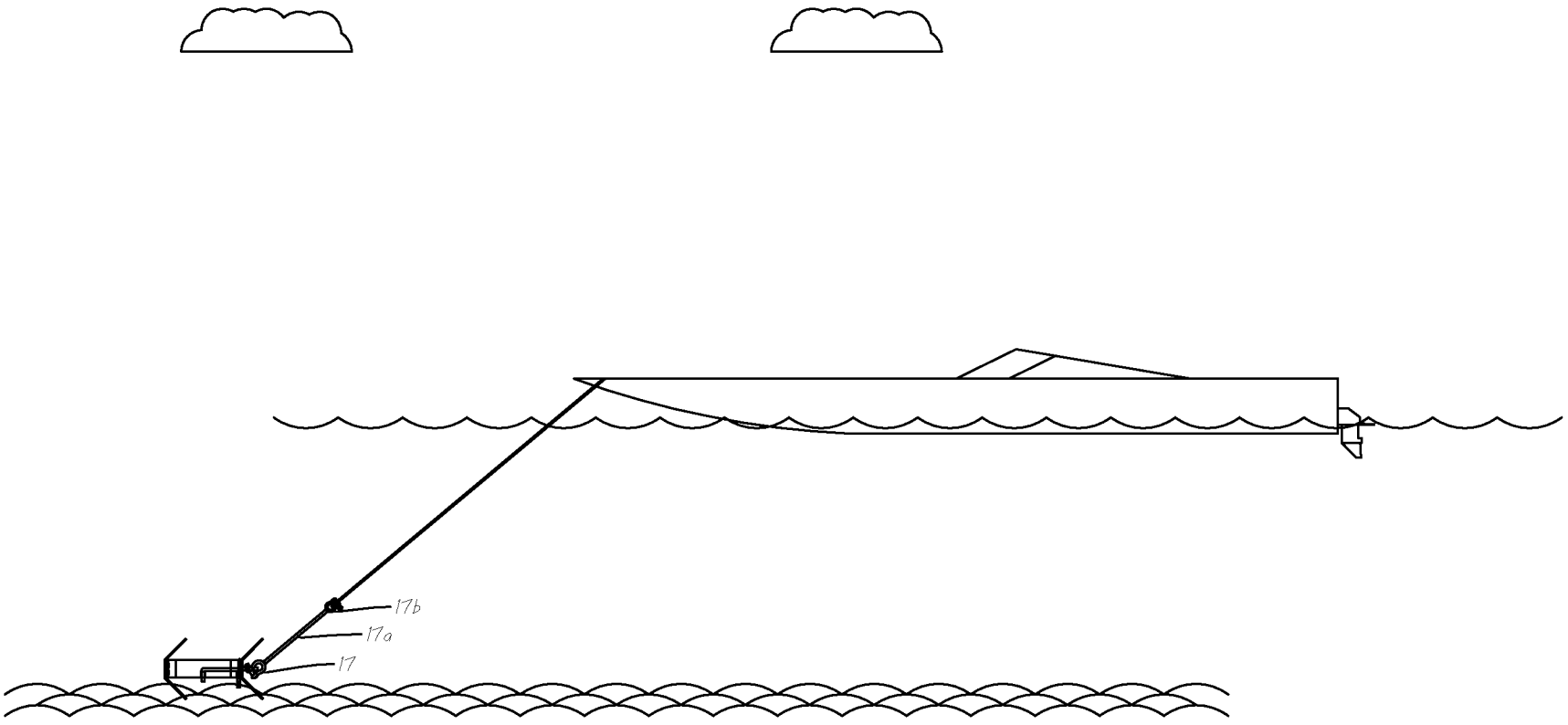
FIGS. 9 and 10 illustrate the anchoring device of the present invention shown anchoring a boat to a lake bed.
Figure 10:
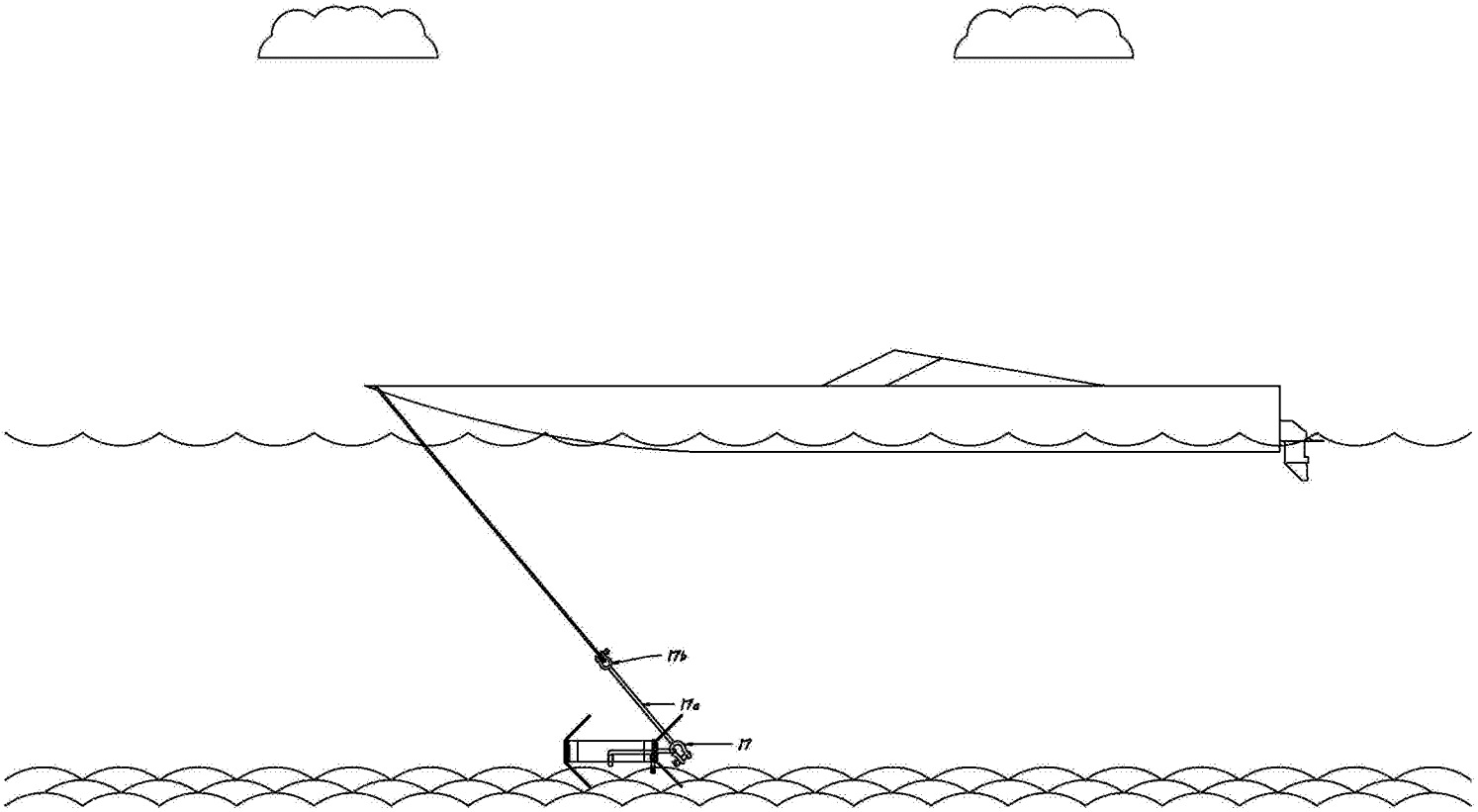

As shown in FIGS. 9 and 10, the anchoring device of the present invention is used to anchor a boat to the bottom of the lake, river, and or inner ocean floor in its box/square form in water application. The teeth of the anchor grab into the ground creating a solid hold, which allows the boat to stay in its area. It will not matter how choppy the water is or if it's a windy day, the anchor is designed to dislodge from the bottom of the lake, river, and/or inner-ocean areas, flip over, and lodge itself back into the earth.

Figure 11:
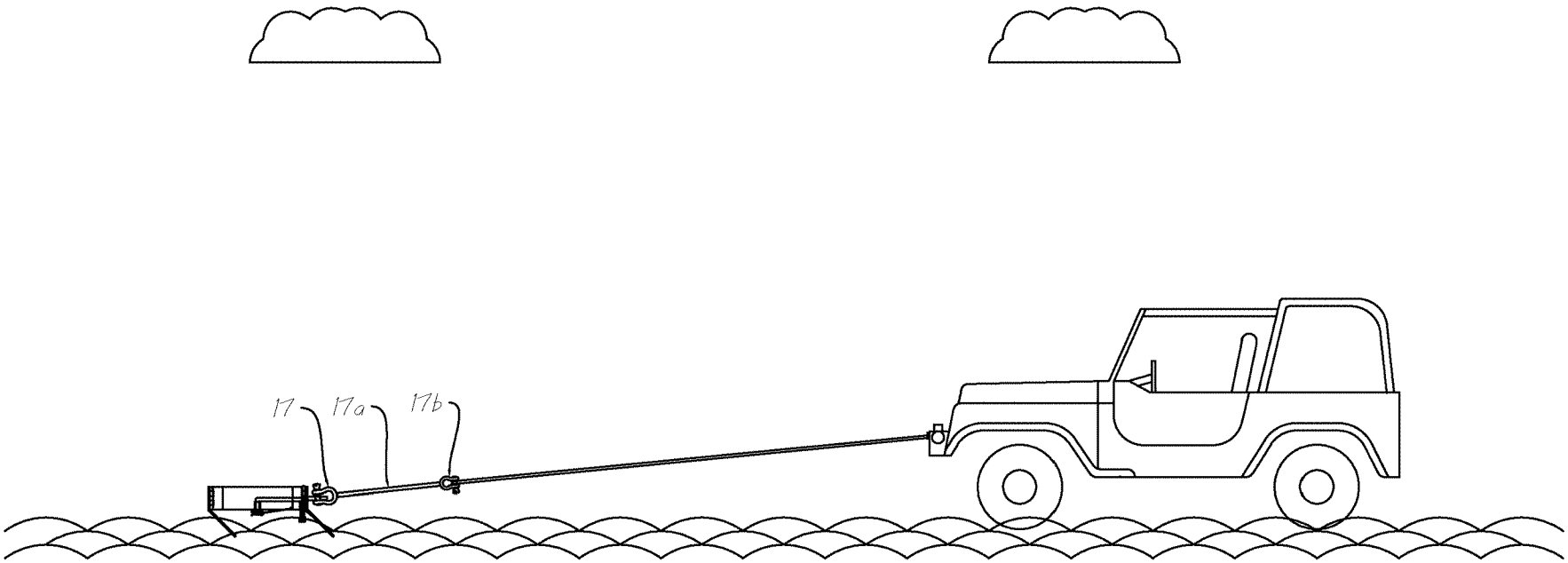
FIG. 11 illustrates the anchoring device of the present invention being used as a stationary point to winch a vehicle free from a stuck position.

As shown in FIG. 11, the anchoring device of the present invention is used to anchor a boat to the bottom of the lake, river or other body of water.

FIG. 11 illustrates the anchoring device of the present invention being used as a stationary point to winch a vehicle free from a stuck position.

The following table summarizes the various component parts of the present invention as illustrated in FIGS. 1-8 and 12:

Reference No. 9: HD Lay flat foldable anchor;
Reference No 10: Left and rear front and left and rear back HD Weld-able Hinge with a solid or a stainless-steel bolt and nylon nut;
Reference No. 11: Upper left right anchor tooth;
Reference No. 11*a*: Upper rear right side anchor tooth;
Reference No. 12: Lower rear left anchor tooth;
Reference No. 12*a*: Lower rear right anchor tooth;
Reference No. 13: Lower front left anchor tooth;
Reference No. 13*a*: Lower front right anchor tooth;
Reference No. 14: Upper front left anchor tooth;
Reference No. 14: Upper front right anchor tooth;
Reference No. 15: Left side panel;
Reference No. 15*a*: Rearward back/bottom panel;
Reference No. 15*b*: Right side panel;
Reference No. 15*c*: Forward front facing panel;
Reference No. 16: ½" front drag bar attachment;
Reference No. 17: ⅜" or ½" drag bar attachment;
Reference No. 17*a*: Drag Bar assemble;
Reference No. 17*be:* ⅜" or ½" drag bar tie off attachment;
Reference No. 18: Receiving lock tube;
Reference No. 19: Lock Bar;
Reference No. 20: Lock bar pivot;
Reference No. 21: Lock Bar safety Cable;
Reference No. 22: Lock Bar safety hitch pin;
Reference No. 23: Lock Bar return spring;
Reference No. 24: Rear Relief center drain Holes;
Reference No. 24*a*: Right side Rear Relief drain Holes;
Reference No. 24*b*: Left side Rear Relief drain hole;
Reference No. 24*c*: Right Side Rear upper drain hole;
Reference No. 24*d*: Left side Rear upper drain hole;
Reference No. 25: Left rear side lower drain hole;
Reference No. 25*a*: Right rear side lower drain hole;
Reference No. 26: Front center relief hole;
Reference No. 27: Left front upper relief home;
Reference No. 27*a*: Right front upper relief hole;
Reference No. 28: Left lower relief hole;
Reference No. 28*a*: Right lower relief hole;
Reference No. 29: Nylon Lock Nut;
Reference 30: Safety attachment hole While the foregoing specification teaches the principles of the present invention, with examples provided for the purpose of illustration, it will be appreciated by one skilled in the art from reading this disclosure that various changes in form and detail can be made without departing from the true scope of the invention.

I claim:

1. A collapsible anchoring device, said device comprising:

a frame of generally square form and having a front and rear section;

said frame including a plurality of spades attached to said front and rear section ranging from 35 to 55-degree angles; and a handle bar attached to said frame and adapted for attachment to a boat anchor line.

* * * * *